US007749362B2

(12) United States Patent
Glass et al.

(10) Patent No.: US 7,749,362 B2
(45) Date of Patent: Jul. 6, 2010

(54) PROTECTION OF REINFORCEMENT

(76) Inventors: Gareth Glass, 3 Hillside, Lichfield, Staffordshire (GB) WS14 9DQ; Adrian Roberts, 11 Calvert Close, Chilwell, Nottingham, Nottinghamshire (GB) NG9 5HG ( * ) Notice: Subject to any disclaimer, the term of this patent is extended or adjusted under 35 U.S.C. 154(b) by 532 days.

(21) Appl. No.: 11/577,661

(22) PCT Filed: Oct. 17, 2005

(86) PCT No.: PCT/GB2005/050186

§ 371 (c)(1),
(2), (4) Date: Apr. 20, 2007

(87) PCT Pub. No.: WO2006/043113

PCT Pub. Date: Apr. 27, 2006

(65) Prior Publication Data

US 2008/0105564 A1 May 8, 2008

(30) Foreign Application Priority Data

Oct. 20, 2004 (GB) ..... 0423251.8

(51) Int. Cl.
*C23F 13/16* (2006.01)
*C23F 13/06* (2006.01)
*C23F 13/08* (2006.01)

(52) U.S. Cl. ..... 204/196.19; 204/196.18; 204/196.22; 204/196.23; 204/196.24; 204/196.25; 204/196.37; 29/745; 29/746

(58) Field of Classification Search ..... 204/196.18, 204/196.19, 196.22, 196.23, 196.24, 196.25, 204/196.37; 29/745, 746
See application file for complete search history.

(56) References Cited

U.S. PATENT DOCUMENTS 2,565,544 A 8/1951 Robert
3,186,931 A 6/1965 Glenn et al.
3,441,491 A 4/1969 Percy (Continued)

FOREIGN PATENT DOCUMENTS

GB 670482 A 4/1952

(Continued)

OTHER PUBLICATIONS

Glass et al, Theoretical Basis for Designing Reinforced Concrete Cathodic Protection Systems, pp. 175-184, British Corrosion Journal, vol. 32, No. 3, 1997.

(Continued)

*Primary Examiner*—Bruce F Bell

(57) ABSTRACT

A method of protecting steel in concrete is disclosed. It consists of connecting the steel (6) to a discrete sacrificial anode assembly (7) comprising a base metal (1), a relatively small quantity of catalytic activating agent in contact with the base metal and a substantially inert porous layer (3) that surrounds the base metal and catalytic activating agent. The inert porous layer efficiently maintains a sustainable concentration gradient of the catalytic activating agent between the base metal and the surrounding environment as a result of the electric field across this layer. The preferred porous layer comprises a material that exhibits a net repulsion of negative ions from its pore system and the preferred catalytic activating agent comprises doubly charged sulphate ions as small electric fields maintain very high concentration gradients of these ions resulting in high concentrations at the base metal surface and insignificant concentrations at the assembly periphery.

23 Claims, 8 Drawing Sheets

U.S. PATENT DOCUMENTS

| | | | | |
|---|---|---|---|---|
| 5,650,060 | A | 7/1997 | Huang et al. | |
| 6,022,469 | A | 2/2000 | Page | |
| 6,193,857 | B1 * | 2/2001 | Davison et al. | 204/196.01 |
| 6,217,742 | B1 | 4/2001 | Bennett | |
| 6,303,017 | B1 | 10/2001 | Page et al. | |
| 6,540,886 | B1 | 4/2003 | Russell | |
| 6,572,760 | B2 | 6/2003 | Whitmore | |
| 6,793,800 | B2 | 9/2004 | Whitmore | |
| 6,958,116 | B1 * | 10/2005 | Bennett | 205/734 |
| 7,488,410 | B2 * | 2/2009 | Bennett et al. | 205/734 |
| 2004/0238347 | A1 * | 12/2004 | Bennett | 204/196.01 |
| 2007/0194774 | A1 * | 8/2007 | Bennett et al. | 324/71.2 |
| 2008/0047843 | A1 * | 2/2008 | Glass et al. | 205/730 |
| 2008/0073223 | A1 * | 3/2008 | Glass | 205/734 |
| 2008/0230398 | A1 * | 9/2008 | Glass et al. | 205/734 |

FOREIGN PATENT DOCUMENTS

| | | | |
|---|---|---|---|
| WO | 20041057057 | A | 7/2004 |

OTHER PUBLICATIONS

Specification for Sulfate-Resisting Portland Cement, British Standards Institution, BS 4027, 1996.

Cement- Part 1: Compositions, Specifications, and Conformity Criteria for Common Cements, British Standards Institution, BS EN 197 1:2000, Incorporating Amendment No. 1, 2004.

* cited by examiner

PROTECTION OF REINFORCEMENT

TECHNICAL FIELD

This invention relates to the protection of steel reinforcement in concrete construction using sacrificial anodes and in particular to the activation and containment of components of the material used to maintain sacrificial anode current output in reinforced concrete.

BACKGROUND ART

Sacrificial cathodic protection is a technique that is used to control the corrosion of steel. It involves connecting to the steel a base metal or alloy that is less noble than steel, such as a metal or alloy of zinc, aluminium or magnesium. The base metal is consumed by anodic dissolution and in the process current flows to the steel which becomes the protected cathode of the base metal-steel couple.

One application of sacrificial cathodic protection is to protect steel reinforcement in concrete. U.S. Pat. No. 6,022,469 describes the use of sacrificial anodes in the repair of corrosion damaged concrete structures. Sacrificial anode systems may be applied to a concrete surface (U.S. Pat. No. 5,650,060) or may be embedded as compact discrete anodes within the concrete (U.S. Pat. No. 6,572,760). A description of discrete impressed current and sacrificial anodes is given in U.S. Pat. No. 6,217,742. The ratio of anode to steel surface area affects the anode current density required to protect the steel and the relatively small surface of discrete anodes means that relatively high anode current densities may be required from discrete anodes. However they are strongly attached to the structure and anode attachment failures are much less common for discrete anodes than for the non-discrete anodes that are applied to concrete surfaces.

Sacrificial anodes sometimes experience reduced current output as a result of base metal inactivity. This was observed with the usual zinc and magnesium sacrificial anodes employed in soil environments. As a result, chemical backfills into which the zinc or magnesium is placed were developed. These backfills consist of a powdered mixture of hydrated gypsum, bentonite and sodium sulphate and the recipe will depend on the resistivity of the environment. In higher resistivity environments, the sodium sulphate content of the backfill is sometimes increased.

Sacrificial anodes have been applied to reinforced concrete exposed to marine environments where chloride contamination maintains base metal activity and anode current output. However the addition of halide ions like chloride to sacrificial anode assemblies is discouraged because these ions induce corrosion of the steel, and in other concrete environments a reduction in anode current output presents problems.

WO 2004/057057 describes the use of conventional gypsum, bentonite, sodium sulphate backfills to maintain the current output of sacrificial anode assemblies applied to a concrete surface. The advantage of using such backfills is that anode performance has been characterised. However, such backfills are associated with a number of disadvantages. They are in powdered form and are not easily retained on the concrete surface. It is difficult to prevent active components in the backfill from leaching out particularly when they are applied while the concrete or repair mortar is still fluid. The backfill tends to expand or contract with changing moisture conditions and this dimensional instability is difficult to accommodate in concrete and could result in a loss of contact between the anode and the surrounding concrete.

The use of sulphate or chloride ions in the backfill is discouraged by the deleterious effects these ions can have on the reinforcing steel and concrete. Alternative options devised to maintain base metal activity in concrete include exposure of the base metal to alkali and humectants (deliquescent materials). U.S. Pat. No. 6,303,017 describes the use of compounds like KOH and LiOH to maintain an environment around the base metal that is sufficiently alkaline to prevent base metal passivation. LiOH is preferred because KOH can induce a problem known as alkali silica reaction in concrete. However, LiOH does present health and safety problems that restrict its use. A combination of an alkali and a humectant such as $LiNO_3$ are described in U.S. Pat. No. 6,572,760. U.S. Pat. No. 6,217,742 describes the use of combinations of the humectants, ($LiNO_3$ and LiBr), to enhance the current output of sacrificial anode assemblies. However, while halide ions like bromide and chloride are very efficient in maintaining base metal activity, they can also induce corrosion of the steel reinforcement. To overcome such a corrosion risk, U.S. Pat. No. 6,793,800 describes a sacrificial anode assembly that uses a combination of a humectant and a steel corrosion inhibitor.

This invention is concerned with backfills that maintain base metal activity in concrete and improved methods of minimising the deleterious effects of the materials that maintain base metal activity on the surrounding reinforced concrete. This involves giving the backfill increased dimensional stability, containing the activating material of the backfill in the vicinity of the anode and providing a means of countering the deleterious nature of the adverse effects resulting from leaching of the activating material into the surrounding concrete.

DISCLOSURE OF INVENTION

Technical-Problem

Concrete is a resistive environment that inhibits the operation of sacrificial anode assemblies embedded within it. The use of conventional sacrificial anode backfills developed for resistive soils is mired by the deleterious effects of some of the ionic components they contain on the reinforced concrete, the dimensional instability of the backfill in a range of moisture conditions and the need to contain the backfill and its active ingredients in the vicinity of the base metal. In addition some of the components of other materials that may be used to maintain base metal activity in concrete may also induce damage to both the concrete and the steel reinforcement. The risk of inducing damage will be minimised if the components that potentially induce damage are contained within the sacrificial anode assembly. However the method of containment must allow current to flow in the form of ions from the base metal of the anode assembly to the protected steel through the environment between the base metal and the steel.

Technical-Solution

According to the present invention there is provided a method of protecting steel in concrete which comprises connecting the steel to a discrete sacrificial anode assembly located in a cavity in the concrete. The discrete sacrificial anode assembly comprises a base metal such as a metal or alloy of zinc, aluminium or magnesium in contact with a catalytic activating agent such as sulphate or halide ions. The activating agent and the base metal are substantially surrounded by at least one dimensionally stable solid porous inorganic layer that is inert in that it does not substantially react with the activating agent to remove it from the soluble phase. The inertness of the inorganic porous layer limits the removal of the activating agent from solution that would draw the activating agent away from the base metal. Inorganic layers are preferred because they tend to be more compatible with the surrounding concrete. The substantially inert porous inorganic layer allows the establishment of a high sustainable concentration gradient of activating agent between the base metal and the surrounding reinforced concrete as well as a high concentration near the base metal with the inclusion of a relatively limited quantity of activating agent in the assembly. This porous layer inhibits the movement of the activating agent away from the base metal but it does not stop the flow of ionic current between the base metal and the protected steel. The activating agent may itself be contained within an inorganic porous layer such as hydrated gypsum. However it is preferable to substantially surround the layer containing the activating agent with a second layer that initially contains no activating agent to inhibit the movement of the activating agent into the surrounding concrete. An example of such a layer that may be used to separate the gypsum layer from the surrounding concrete is a layer of hydrated sulphate resisting Portland cement. Another type of layer that may be used to inhibit the movement of the activating agent away from the base metal is a layer that allows positive ions to pass through its pore system but impedes the passage of negative ions as the result of the charge on the walls of the pore system. Inorganic materials that have this property include some clays, and zeolites. The connection between the sacrificial anode assembly and the reinforcing steel involves forming an electronic connection between the base metal and the steel using an electronic conductor and forming an ionic connection between the base metal and the steel by maintaining electrolytic contact through at least one layer to the parent concrete that is part of the reinforced concrete structure.

Advantageous Effects

This invention allows the use in concrete of established solutions to the problems arising when sacrificial anodes are used in resistive environments, solutions involving the exposure of the anode to aggressive agents such as sulphate or halide ions that would otherwise cause reinforced concrete deterioration. Such solutions have a relatively low health and safety risk and allow the use of established parameters for anode efficiency when calculating anode output and anode life.

MODE FOR INVENTION

Figure 1A:
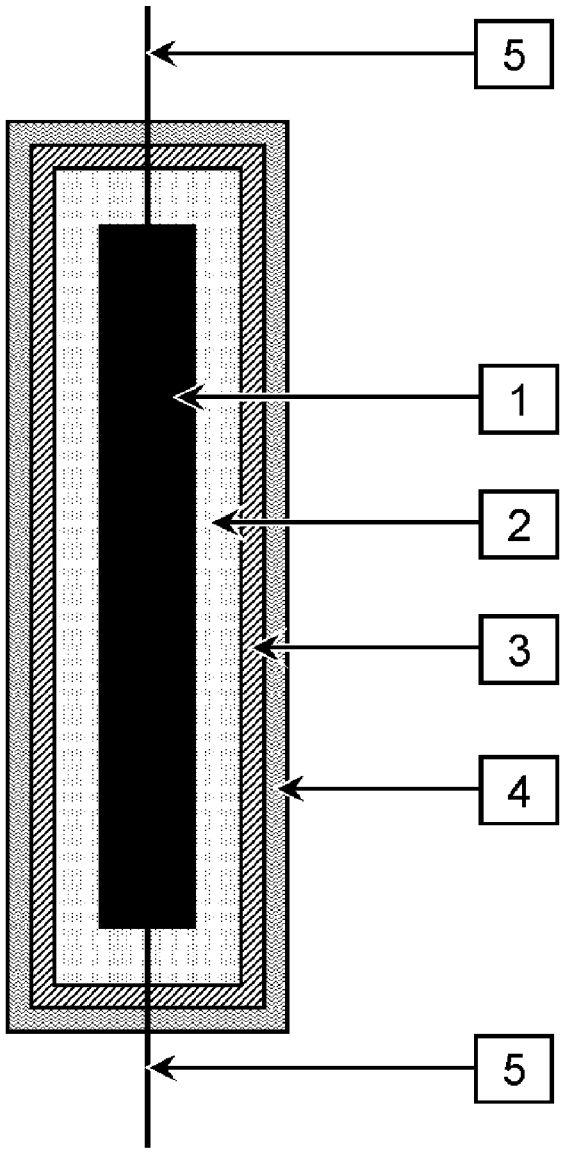
FIGS. 1(*a*) and (*b*) shows two sections through one embodiment of the anode assembly.
Figure 1B:
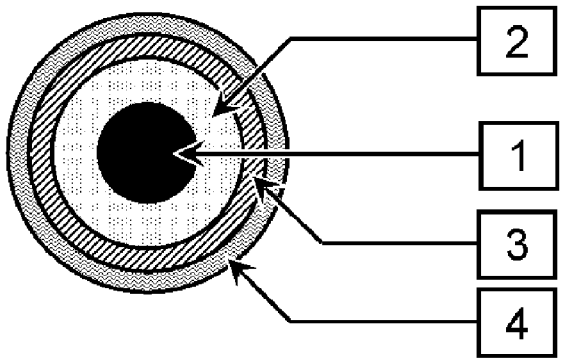
Figure 2:
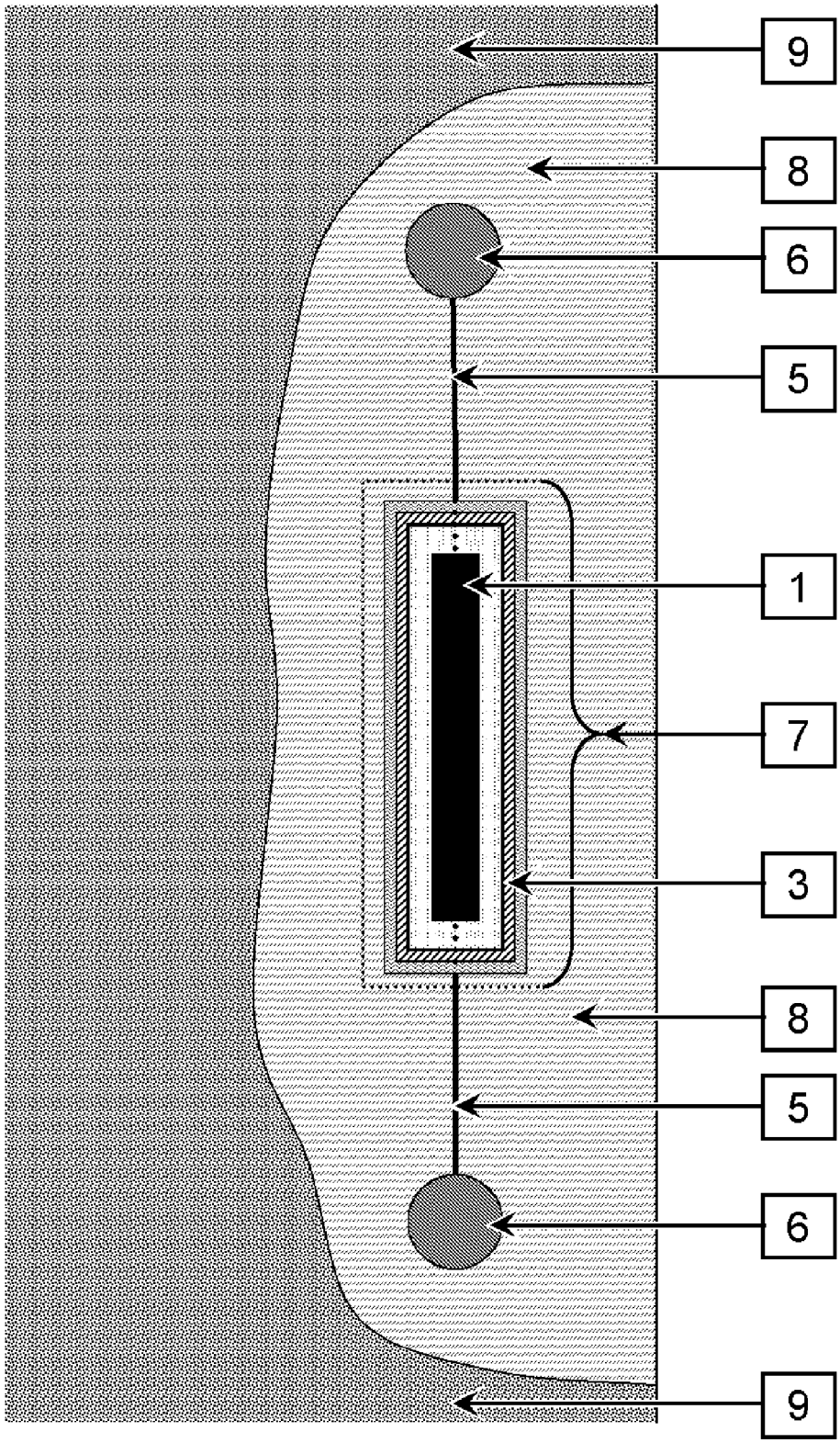
FIG. 2 shows a section through an arrangement that could be used to protect steel in concrete.

One arrangement of the discrete sacrificial anode assembly is given in FIGS. 1 and 2. The assembly comprises a base metal [1] that is less noble than steel, and a porous ionically conductive backfill that maintains efficient base metal activity which preferably has a layered structure. Inner [2], central [3] and outer [4] layers of the backfill are shown in FIG. 1 although not all layers are essential. The purpose of the layers is to form a concentration gradient of a catalytic activating agent between the base metal and the surrounding environment with the catalytic activating agent being primarily contained close to the base metal. A conductor [5] is connected to the base metal to facilitate the electrical connection of the base metal to the steel.

The base metal [1] is a metal or alloy such as zinc, aluminium or magnesium or an alloy thereof that will corrode in preference to the reinforcing steel when they are connected together. The base metal is the anode in the anode assembly, i.e. the electrode on which oxidati on occurs. A preferred base metal is an aluminium alloy because of the high charge density of aluminium and the large potential difference between activated aluminium and steel. Suitable aluminium alloys are described in U.S. Pat. No. 4,141,725.

The backfill is a medium that contains agents that maintain base metal activity. The activating agent in contact with the base metal consists of negative ions that act as catalysts for base metal dissolution and are largely regenerated at the end of the metal dissolution reaction. Such ions are very effective in maintaining base metal activity. Examples include sulphate or halide ions. Halide ions include chloride and bromide ions. Indeed, because the electric field established between the base metal and the steel may draw more activating agents to the base metal, the activation of the base metal may be referred to as autocatalytic.

The activating agent may be contained in a porous layer [2] in contact with the base metal. An example of such a porous material is anhydrous calcium sulphate or a hemi hydrate plaster that has been hydrated with the addition of water that contains alkali metal sulphates ($Na_2SO_4$ or $K_2SO_4$) to form a porous rigid gypsum material. The material gels to form a solid more rapidly as the alkali metal sulphate content is increased. To maintain a reasonable period over which the material is workable, the water content can be increased. This increases the porosity of the resulting material. This rigid porous material exhibits excellent dimensional stability in a wide range of moisture conditions. The dimensional stability can be further improved by including a dimensionally stable filler such as sand in the mixture used to form the gypsum.

The sulphate and halide ions that catalyse anode activity may also attack the surrounding concrete or the reinforcing steel and are often referred to as aggressive ions. It is therefore necessary to separate these ions from the surrounding concrete by at least one layer of porous material [3]. The function of this layer is to establish a concentration gradient of catalytic activating ions between the base metal and the surrounding environment. This is best achieved using a material that does not substantially react with the catalytic activating agent to remove it from the soluble phase as this would draw the activating agent away from the base metal. Examples include substantially carbonated hydraulic cements, hydraulic cements with a low reactive calcium aluminate content such as sulphate resisting Portland cement, magnesium phosphate cements, lime mortars and lime putties, ettringite based cements including calcium sulpho-aluminate cements and ceramics such as fired clay. Some common hydraulic cements are described in BS EN 197-1: 2000 although many of these are electrically very resistive or contain substantial quantities of the reactive calcium aluminate phase that removes catalytic activating agents from the soluble phase. Sulphate resisting Portland cement is described in BS 4027: 1996 and the quantity of reactive calcium aluminate phase in this cement is limited.

When a sacrificial anode is connected to a steel cathode, ionic current flows such that negative ions are drawn to the anode. These ions include sulphate and halide ions. The electric field resulting in this movement of ions will counter the effect of a concentration gradient that results in the movement of negative activating ions away from a location where they are concentrated near the anode. A steady state will be reached where the concentration of negative activating ions will decrease with an increase in the distance from the base metal.

The potential difference in mV denoted by the symbol (ΔE), required to separate different ionic concentrations denoted $C_0$ and $C_1$, may be approximated by the equation (British Corrosion Journal Vol. 32 (1997) 179-184):

$$\Delta E = \frac{60}{z}\log\left(\frac{C_1}{C_0}\right) \quad \text{(Equation 1)}$$

The value of 60 in equation 1 will vary slightly with temperature. The symbol z is the charge number of the negative ion. For chloride ions z is 1. For sulphate ions z is 2. The log function is to the base 10 and converts a concentration ratio of 10 into the number 1 and a concentration ratio of 100 into the number 2. Thus to maintain a concentration ratio of 100 for sulphate ions, approximately 60 mV will be needed and 120 mV will be needed if a similar ratio was required for chloride ions. It is therefore easier to sustain a concentration gradient of sulphate ions using an electric field.

The above calculations are applicable to ideal solution theory and are approximate for real solutions. The approximation is improved if the porous material around the anode does not react with the activating agent to remove the activating agent from the soluble phase.

The potential difference (ΔE)

induced in an environment between parallel electrodes separated by a fixed distance denoted by the symbol

δ is directly proportional to the electrolyte resistivity denoted by the symbol

ρ and current density denoted by the symbol i, and is given by the equation:

$$\Delta E = i\rho\delta \quad \text{(Equation 2)}$$

To obtain the potential difference in a layer covering a cylindrical electrode it is necessary to integrate equation 2 from the inner radius denoted $r_1$ to the outer radius denoted $r_2$ of the layer covering the cylinder taking into account the variation in the current density that will occur as the radius of the cylinder increases. The potential difference in mV over the layer covering the cylinder is given by the equation:

$$\Delta E = 0.366\rho I_L \log\left(\frac{r_2}{r_1}\right) \quad \text{(Equation 3)}$$

In this case the anode has a radius denoted $r_1$, and the current leaving the anode per unit length of the cylindrical anode is denoted $I_L$. For an anode with a radius of 7 mm and a current density of 400 mA/m$^2$ (equivalent to a current per unit length of 17.6 mA/m), a layer 5 mm thick with a resistivity of just 40 Ohm m (4 k Ohm cm) would have a potential difference across it of 60 mV which should be sufficient to maintain a sulphate ion concentration ratio of 100 across it. It may be noted that the units of the potential difference in Equations 2 and 3 depends on the units of other parameters in these equations.

It is preferable to assemble the anode assembly with as little catalytic activating agent as possible to avoid the risk presented by the activating agent to the surrounding steel and concrete. This may be achieved by optimising the properties of the layer [3] that substantially surrounds the base metal and activating agent using equations like those given in Equations 1 and 3 above. The aim of this optimisation process is to achieve a concentration gradient across this layer [3] that allows a sufficiently high concentration of catalytic activating agent at the base metal surface to maintain base metal activity, while the concentration in the outer surface of this layer presents no significant risk to the surrounding steel and hydrated cement. At the same time this layer must not be too resistive to prevent ionic current from passing between the base metal and the steel. This may be achieved by optimising the thickness and resistivity of this layer [3].

It is preferable that the layer [3] that substantially surrounds the base metal and catalytic activating agent contains no significant quantity of activating agent in its outer surface that might diffuse into the surrounding concrete to cause damage to the surrounding concrete or steel encased within it. This presents some production difficulties when this layer is formed from a slurry of a cementitious material that subsequently hardens. While the layer is a slurry, the activating agent may rapidly diffuse through it. The problem is aggravated by the high solubility of catalytic activating agents. To overcome this problem, it is preferable to form this layer [3] as a mould that is allowed to harden and, after it has cured, to assemble the base metal and activating agent in this mould. Such a mould may for example, be a tube that can be sealed with a sealer at its open ends after the base metal and activating agent have been assembled within it. Furthermore, to inhibit the diffusion of the activating agent into the porous layer [3] that substantially surrounds the base metal and catalytic activating agent in the absence of an electric field prior to using the anode, the porous layer and the rest of the anode assembly may be kept dry.

It is preferable that the layer [3] that substantially surrounds the catalytic activating ions selectively impedes the movement of negative ions via an ion exchange mechanism that also allows positive ions to pass through more freely. A layer with an open pore structure that has a negative charge on its pore walls may achieve this. The negatively charged pore wall surface will attract positive ions into the pores and repel negative ions from the pores. The selective impedance to sulphate ion transport is aided by the double negative charge of the sulphate ion. Such a layer will slow down the rate at which aggressive ions move from the base metal into the surrounding environment.

Porous inorganic layers that selectively impede the transport of negative ions include those that utilise the negative charge present on the surface of some silicate particles. Some crystalline aluminosilicates such as clays and zeolites have these properties. Zeolites have a three dimensional rigid structure. Clays have a two dimensional layered structure and are more flexible. Variations in the charge density on the pore wall and pore structure are possible. A coarse pore structure with a high pore wall charge density is preferred. An example of such a layer is one that is formed using the clay known as Laponite.

Organic materials that have this type of ion exchange property include polymers with an acid functionality. U.S. Pat. No. 6,540,886 describes an organic membrane and its use to separate the electrolyte around an anode of an impressed current cathodic protection system from the electrolyte in an aqueous environment. U.S. Pat. No. 5,650,060 describes an instance where an organic membrane may be used to impede the movement of hydroxyl ions towards a base metal attached to a concrete surface in a situation where these might render the base metal inactive. However organic membranes tend to be expensive and are not that compatible with concrete.

An outer layer [4] that contains agents that react with and precipitate the escaping activating ions may be added to the assembly . Examples of agents that would precipitate sulphate ions include barium nitrate and the tricalcium aluminate phases in ordinary Portland cement. Tricalcium aluminate may also be used to precipitate chloride ions. The layer in contact with concrete or mortar [4] that consumes escaping activating ions reducing the soluble concentration of activating ions to negligible values must be separated from the layer in contact with the base metal [2] containing the activating ions by a layer [3] that impedes the movement of aggressive ions through it and maintains a high concentration gradient between the base metal and the layer in contact with the concrete. This is because the layer that consumes the aggressive ions may otherwise induce a high concentration gradient that drives the movement of activating ions away from the base metal.

FIG. 2 illustrates the use of the sacrificial anode assembly to protect steel in concrete. In this illustration, two steel bars [6] are exposed in an area of concrete requiring patch repairs. The anode assembly [7] is connected to the steel bars using an electronic conductor [5] such as a metal wire or electrical cable. The repair area is then filled with a repair material [8] that is ionically conductive to connect the assembly to the concrete [9] and provide a path for current to flow via the movement of ions from the base metal to the steel in the concrete.

In the illustration in FIG. 2, the anode assembly is a preformed unit. However the anode assembly may also be formed in situ. This may, for example, be achieved by placing a base metal in a hole in the concrete, connecting it to the reinforcing steel and filling the hole with a material such as plaster that gels to form a dimensionally stable material such as gypsum. If the gypsum contains high levels of free sulphate or halide ions, the concrete in the hole may be first lined with a protective layer that impedes the movement of aggressive ions through it but allows other ions to move through to the concrete to form the ionic connection between the base metal and the steel in the concrete. The use of a relatively weak material such as gypsum allows the sacrificial anode to be easily replaced at the end of its design life.

Other permutations are also possible with anodes formed in situ. Insulating layers may be used to direct the protection current to the steel in the parent concrete that is at risk of corrosion as the result of contamination by previous exposure to chloride ions. By placing an insulating layer on the steel in a repair area, less current will flow to the steel in the new repair material.

EXAMPLES

Specific features of this invention are illustrated with the following examples.

Example 1

A sacrificial anode assembly consisting of a base metal, electron conductor and gypsum containing free sulphate ions was produced and tested. The base metal consisted of a block of aluminium alloy measuring 29.7 mm by 11.9 mm by 8.6 mm. The alloy was US Navy specification MIL-A-24779 (SH). An electron conductor consisting of a 1.0 $mm^2$ sheathed copper core cable was connected to the aluminium alloy. This connection was made by drilling a 4 mm diameter hole to a depth of 8 mm into the 11.9 by 8.6 mm face of the block, stripping away 8 mm of sheath off the end of the copper core cable, inserting the exposed copper core into the drilled hole and securing it with a 3.5 mm diameter aluminium pop rivet in the drilled hole. The connection was insulated with a fast curing silicone sealant obtained from a builder's merchant. Once the sealant had cured, the aluminium block was suspended centrally in a cylindrical plastic mould made from a 50 mm length of 50 mm diameter plastic pipe with a wall thickness of 1.5 mm. The bottom end was sealed to a non-absorbent plastic base with tape. The mould was filled with a fluid homogeneous mixture of domestic multipurpose finishing plaster, potassium sulphate and tap water in the proportions of 19:1:15 by weight respectively. The aluminium anode assembly was demoulded after 24 hours at 20° C. and measured 47 mm in diameter and 48 mm long with a length of sheathed copper cable electrically connected to the aluminium protruding from one of the faces.

Figure 3:
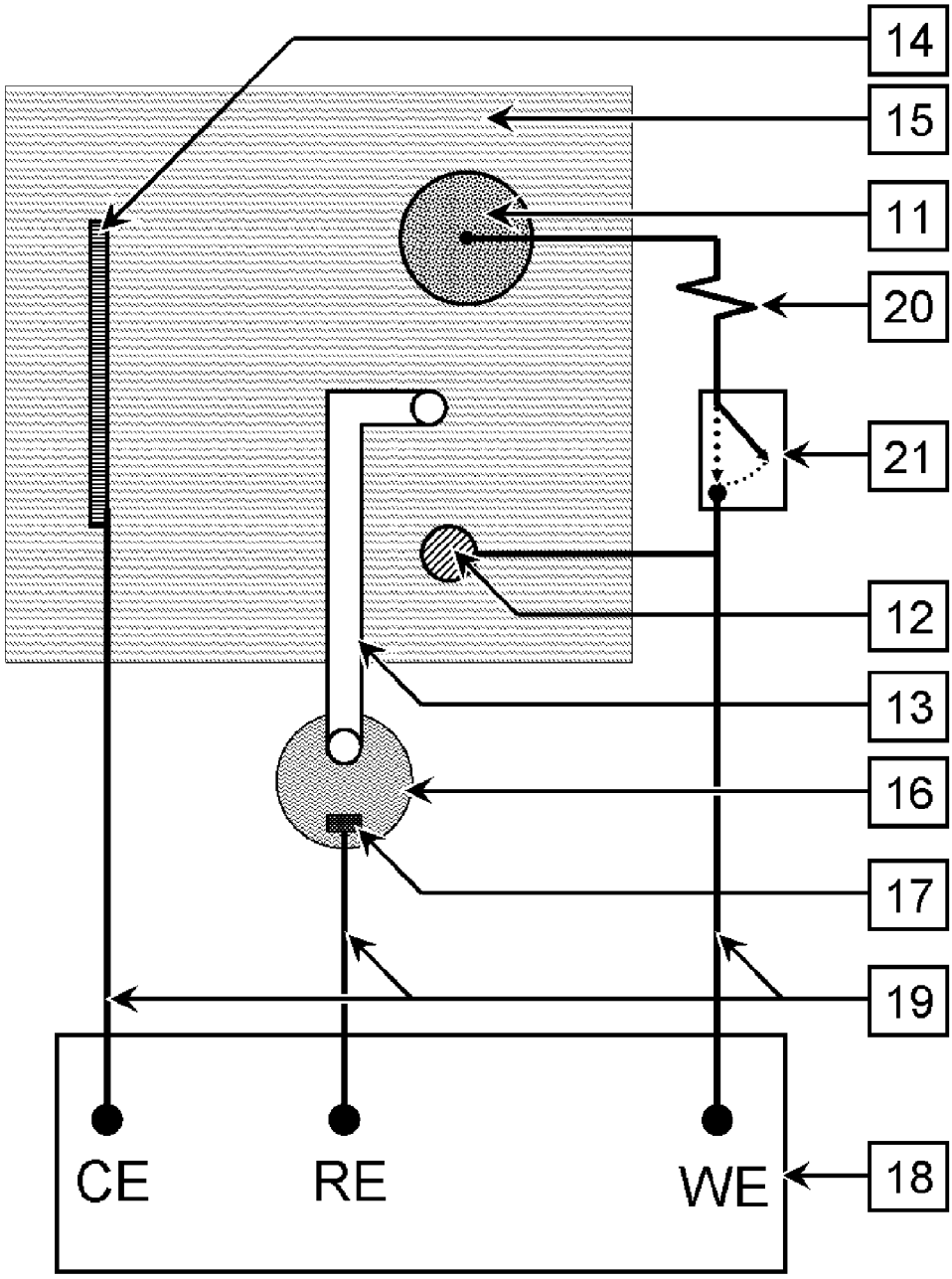
FIG. 3 shows the arrangement that was used to test the anode assemblies in Examples 1, 2 and 3.

The experimental arrangement used to test the aluminium anode assembly is shown in FIG. 3. The aluminium anode assembly [11] a steel bar [12], a Luggin capillary [13] and a counter electrode [14] were cast into a concrete block [15] measuring 110 mm long, 100 mm wide and 100 mm deep using a wooden mould with these internal dimensions. The concrete mix used 20 mm all-in aggregate (0 to 20 mm), ordinary Portland cement and tap water in the proportions of 4:1:0.48 by weight respectively.

The steel bar [12], had a diameter of 10 mm and length of 130 mm. It extended 35 mm above the concrete surface. A 1.0 $mm^2$ sheathed copper core cable was connected to the exposed end of the steel bar in a 4 mm diameter hole drilled into the end using a 3.5 mm pop rivet as described above for the cable-aluminium connection. The steel bar [12] was positioned 20 mm from the external surface of the aluminium anode assembly [11]. The Luggin capillary [13] consisted of a flexible plastic tube with an internal diameter of 2 mm. One end of the Luggin capillary was positioned between the sacrificial anode assembly and the steel in the concrete such that it was 5 to 10 mm from the surface of the sacrificial anode assembly. A counter electrode [14] was made from a length of mixed metal oxide coated titanium ribbon measuring 0.6 mm by 12.6 mm by 45 mm. A copper core cable was connected to the counter electrode and the connection was insulated using a silicone sealant before it was embedded in the concrete.

After one day the concrete was removed from the mould and immersed in water to a depth of 95 mm. The Luggin capillary [13] was filled with conductive gel. This gel was made by heating whilst stirring a mixture of agar powder, potassium chloride and tap water in the proportions of 2:2:100 by weight respectively. The Luggin capillary extended from the concrete to a small container [16] containing a saturated copper sulphate solution. A piece of bright, abraded, copper [17] was placed into the saturated copper sulphate solution to create a saturated copper/copper sulphate reference electrode. A copper core cable was connected to the copper of the reference electrode with the connection being isolated from the copper sulphate solution.

The steel bar, saturated copper/copper sulphate reference electrode and titanium counter electrode were connected to the working electrode (WE) reference electrode (RE) and counter electrode (CE) terminals respectively of a potentiostat [18]. The potentiostat is used to control the potential difference between the working and reference electrode terminals at a preset value by passing a current from the counter electrode to the working electrode. 1 $mm^2$ sheathed copper core cables [19] were used in all the connections. A 1 Ohm resistor [20] and a relay switch [21] was connected between the aluminium anode assembly and the steel. The current flow from the aluminium anode assembly was determined by measuring the voltage drop across the 1 Ohm resistor. The testing took place in laboratory conditions at 15 to 20° C.

Four days after casting the specimen, the potentiostat was set to control the potential of the steel bar at −350 mV relative to the saturated copper/copper sulphate reference electrode. The measurements included the current from the aluminium anode assembly, the current-on potential relative to the reference electrode measured while the current was flowing from the aluminium anode assembly and the instant-off potential of the aluminium anode assembly relative to the reference electrode measured between 0.02 and 0.07 seconds after momentarily interrupting the current from the anode assembly for a period of no more that 0.15 seconds using the relay switch. These measurements were recorded using a high impedance data logger which also controlled the relay switch.

After recording the current, current-on potential and instant-off potential for three days the aluminium anode assembly was put through a polarisation test. A function generator was connected to the potentiostat to change the controlled potential at a rate of 0.33 mV/s and to cycle this change up and down. The data logger recorded the current output of the anode assembly and the instant-off potential while the potential was changed.

Figure 4:
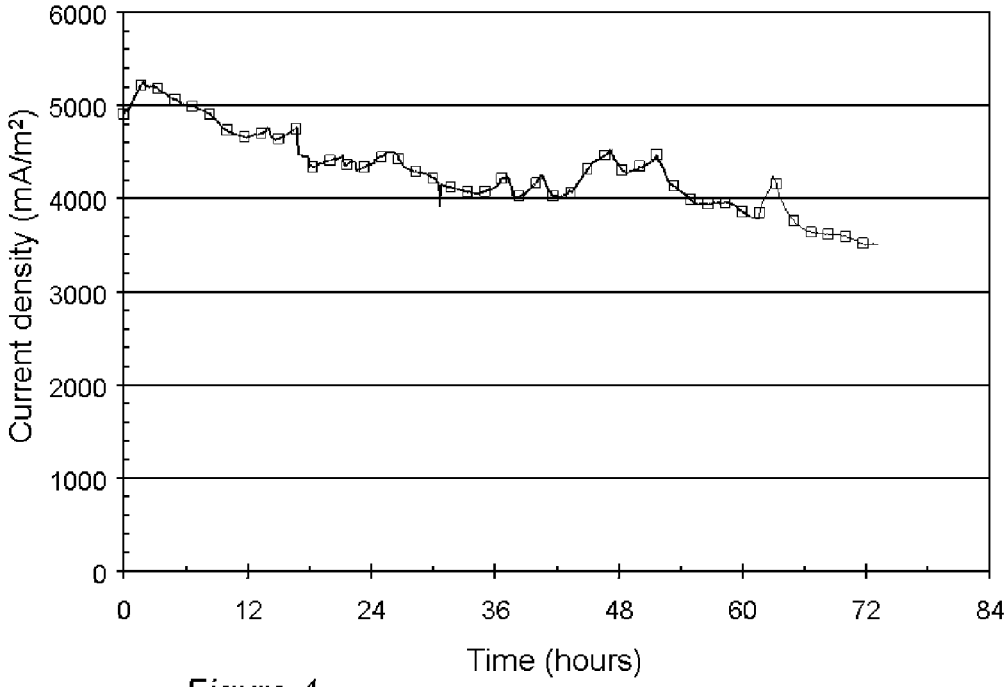
FIG. 4 shows the current output of the anode assembly in Example 1.

FIG. 4 shows the current output of the aluminium anode assembly while it was controlled at a potential of −350 mV relative to the reference electrode. The current on the y-axis is expressed as current per unit area of aluminium surface and is plotted against the time in hours on the x-axis. The current output was very high and decreased from just over 5000 $mA/m^2$ to 3500 $mA/m^2$ over the first 72 hours. This very high current density off the aluminium surface indicates that it is in an active state. It is partly the result of the wet concrete environment.

Figure 5:
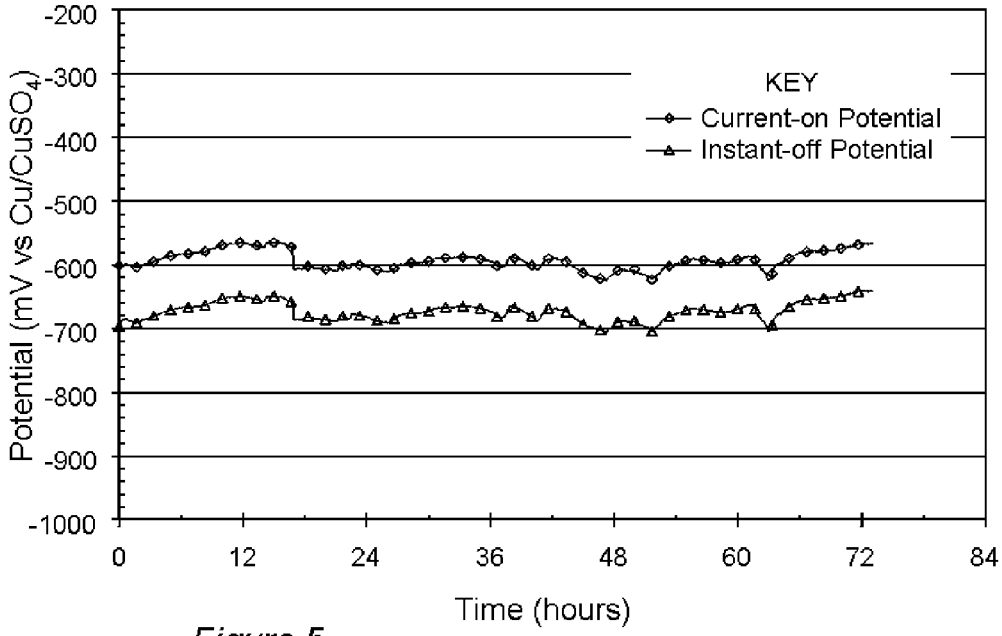
FIG. 5 shows the current-on and instant-off potentials of the anode assembly in Example 1.

FIG. 5 shows the current-on and instant-off potentials of the aluminium anode assembly while it was controlled at a potential of −350 mV relative to the reference electrode. These values remained approximately constant at −600 mV and −680 mV respectively. The relatively positive instant-off aluminium potential is partly responsible for its high current output.

Figure 6:
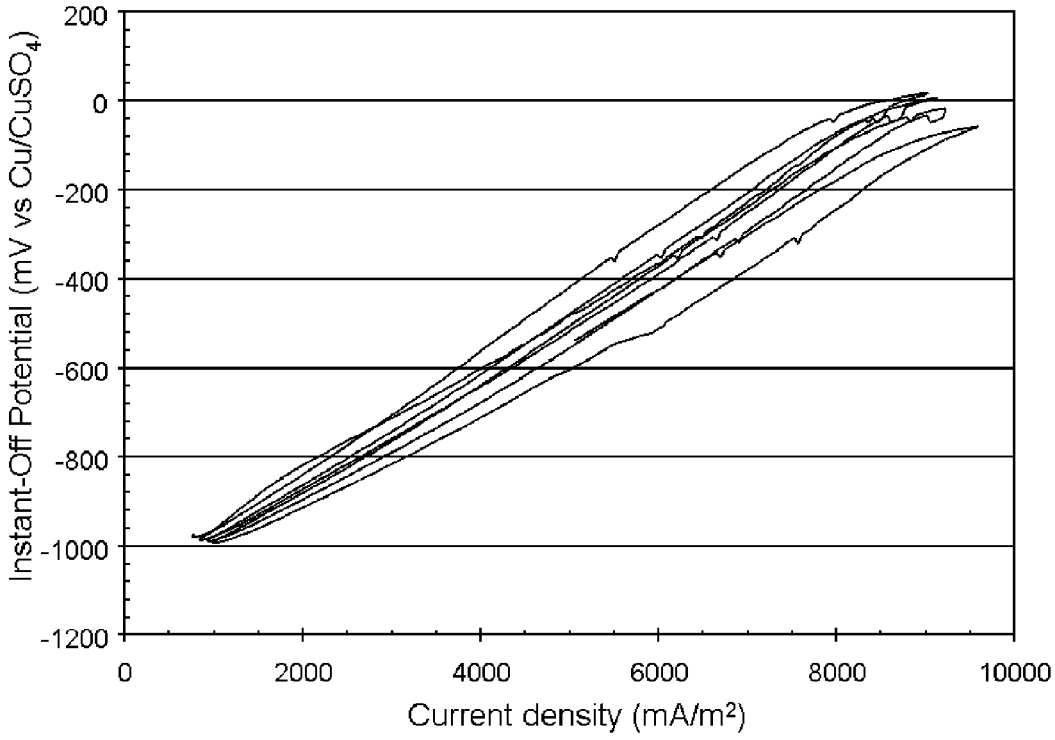
FIG. 6 shows the relationship between the current output and the instant-off potential of the anode assembly in Example 1.

FIG. 6 shows the polarisation behaviour determined on the aluminium anode assembly over 4 successive potential cycles. As the instant-off potential of the anode increased from −1000 mV to 0 mV, the current density off the aluminium increased from under 1000 $mA/m^2$ to 9000 $mA/m^2$.

Example 2

An aluminium anode assembly with layers was produced and tested. The aluminium alloy was the same as that used in Example 1 and the dimensions of the block used were 11.8 mm by 5.2 mm by 27.0 mm. A sealed electrical connection was made on the 11.8 mm by 5.2 mm face of the block which was then located in a cylindrical plastic mould made from a 50 mm length of 50 mm diameter pipe that was filled with a fluid mixture of plaster, potassium sulphate and tap water as described in Example 1. The plaster was then allowed to cure to form a rigid gypsum material with free sulphate ions.

A Laponite clay (grade JS Laponite supplied by Rockwood Additives Ltd. in the UK ) was mixed with deionised water in the proportion 1 Laponite to 5 water by weight using a high shear mixer. The solution was mixed for 20 minutes and allowed to stand for a further 40 minutes before use. A 1 mm thick layer of the resulting mixture was brush applied to the surface of the gypsum and allowed to dry for several hours in laboratory conditions at 15 to 20° C.

High alumina cement, ordinary Portland cement and tap water in the proportions 25:25:19 by weight respectively were mixed together to produce a cement paste with a high calcium aluminate content. This paste was brush applied over the Laponite layer to give an outer layer approximately 2 mm thick which was allowed to cure.

The experimental arrangement used to test the aluminium anode assembly is shown in FIG. 3. The aluminium anode assembly [11] steel bar [12], Luggin capillary [13] and counter electrode [14] were cast into a concrete block [15] as described in Example 1. After one day the concrete was removed from the mould and allowed to dry in laboratory air for a further six days to represent relatively dry test conditions.

The Luggin capillary [13] was filled with conductive gel and extended from the concrete into a small container [16] containing a reference electrode as described in Example 1. The steel bar, saturated copper/copper sulphate reference electrode and titanium counter electrode were connected to the working electrode (WE), reference electrode (RE) and counter electrode (CE) terminals respectively of a potentiostat [18] set at −350 mV to control the potential of the steel bar at −350 mV relative to the reference electrode. The current from the aluminium anode assembly, its current-on potential and its instant-off potential were recorded as described in Example 1. One day after initiating the control of the steel potential at −350 mV, the drying concrete was placed in water to a depth of 95 mm.

Figure 7:
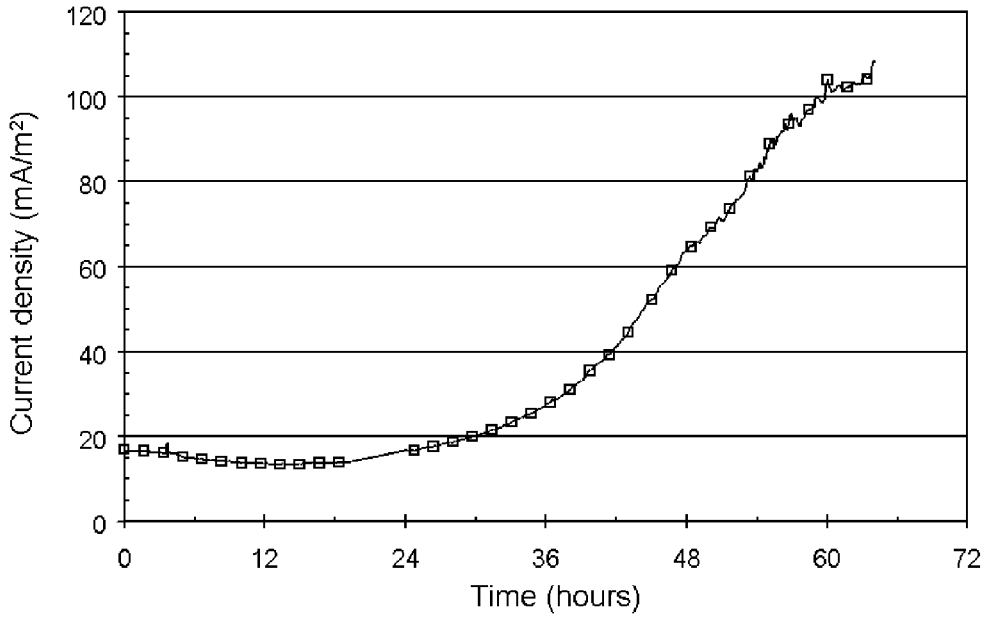
FIG. 7 shows the current output of the anode assembly in Example 2.

FIG. 7 shows the current output of the aluminium anode assembly while it was connected to the steel controlled at a potential of −350 mV relative to the reference electrode. The current on the y-axis is expressed as current per unit area of aluminium surface and is plotted against the time in hours on the x-axis. The current output increased from 20 $mA/m^2$ to 100 $mA/m^2$ over the first 72 hours on exposure of the sample to the water.

Figure 8:
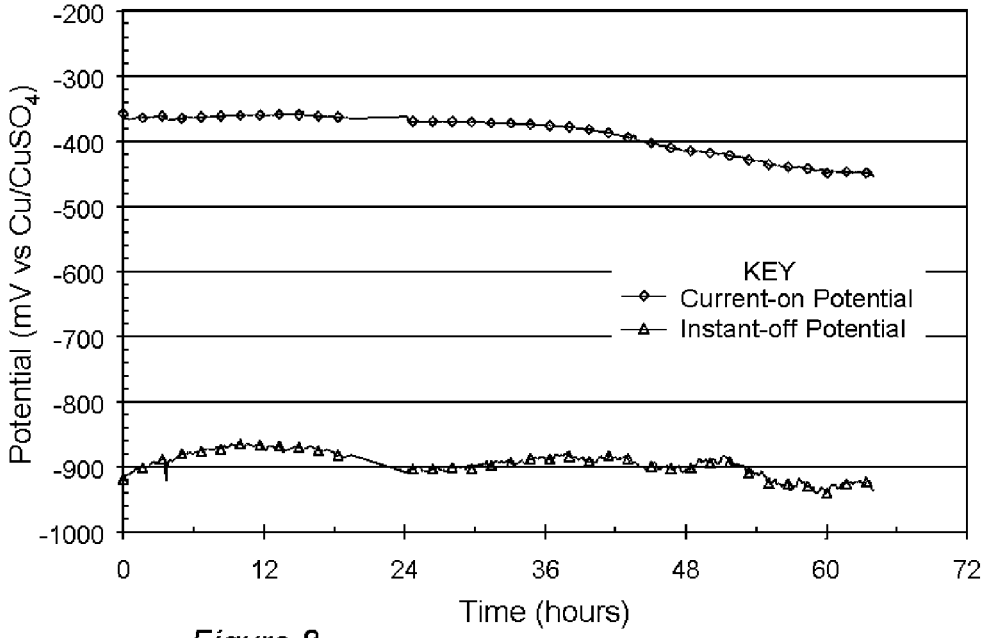
FIG. 8 shows the current-on and instant-off potentials of the anode assembly in Example 2.

FIG. 8 shows the current-on and instant-off potentials of the aluminium anode assembly relative to the reference electrode. The low current output of the assembly was in part due to the relatively negative instant-off potential of the aluminium alloy in the assembly. The large difference between the current-on and instant-off potentials indicates that the resistivity of the environment was relatively high and while some current still flowed, this could explain the lower current output and the negative instant off anode potentials.

Example 3

An aluminium anode assembly with layers was produced as described in Example 2. The dimensions of the aluminium block used were 12.5 mm by 7.7 mm by 20.1 mm and a sealed electrical connection was made on the 12.5 mm by 7.7 mm face of the block. The remaining assembly production detail is identical to that described in Example 2.

The experimental arrangement including the reinforced concrete specimen used to test the aluminium anode assembly is shown in FIG. 3 and described in Example 2. The concrete block into which the anode assembly was cast for testing purposes was removed from the mould after 24 hours. It was then cured standing in water for 68 days at an average temperature of 11° C. The anode was connected to the steel and the steel potential was held at −350 mV relative to the saturated copper sulphate reference electrode from the start of this period to the end of the test. After this period, the block was removed from the water and allowed to dry for a further 11 days at an average temperature of 18° C. whilst a small fan forced air movement around the concrete block to help reduce the humidity of the concrete.

Following this initial period, the anode performance was monitored every hour for the next 21 days. The first 14 days of this monitoring period, the concrete block temperature was maintained between 35 and 38° C. and the following 7 days, the concrete block temperature was maintained at an average 10±5° C. During this 21 day monitoring period, the fan maintained air movement around the concrete block. The hourly measurements included the anode to steel current-on potential across the 10 Ohm shunt resistor, and immediately after this, the anode to steel instant-off potential measured between 0.02 and 0.07 seconds after momentarily interrupting the current from the anode assembly for a period of no more that 0.15 seconds using the relay switch. These measurements were recorded using a high impedance data logger which also controlled the relay switch.

Figure 9:
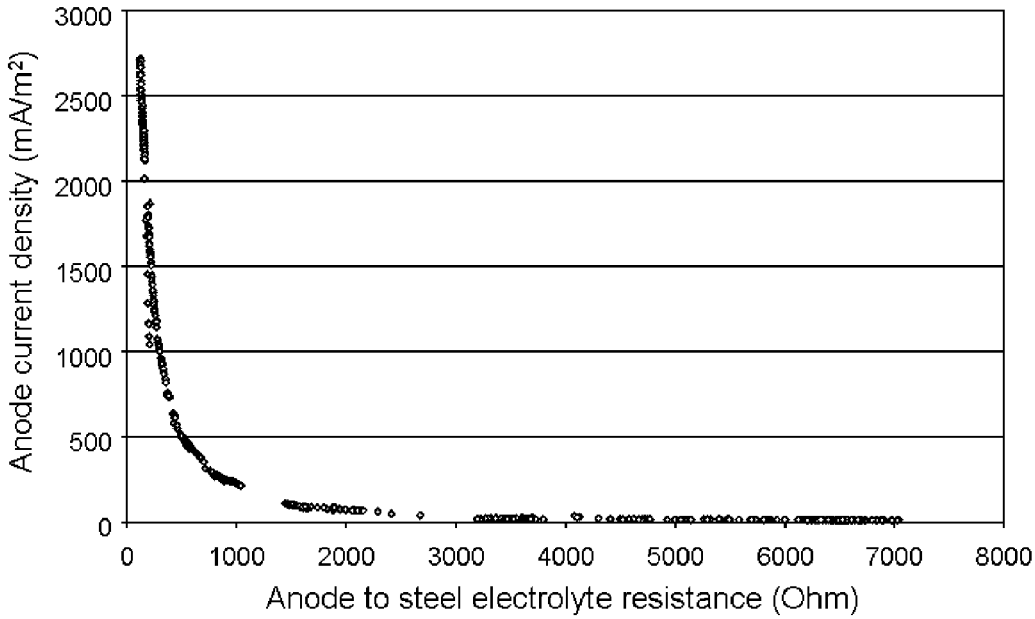
FIG. 9 shows an aluminium alloy anode assembly current density plotted as a function of the anode to steel electrolyte resistance in Example 3.

The current from the aluminium anode assembly was calculated by dividing the anode to steel current-on potential by the value of the shunt resistance and converted to a current density using the exposed aluminium alloy surface area. The electrolyte resistance between the anode and the steel was calculated by dividing the difference between the current-on and instant-off anode to steel potentials by the current flowing just before the instant off anode to steel potential was measured. The anode current density expressed in mA per square meter of aluminium alloy surface is plotted as a function of the electrolyte resistance expressed as ohms in FIG. 9.

The data shows that the current output of the anode assembly responds to the electrolyte resistance between the anode and the steel. The responsive behaviour is such that the anode current output is approximately inversely proportional to the anode to steel electrolyte resistance. This suggests that as the current output reduces the resistance across the solid porous inorganic layer increases and thus the potential drop across the layer substantially surrounding the base metal is effectively maintained. Therefore the electric field across a layer substantially surrounding the base metal that maintains the concentration gradient in activating ions between the base metal and the surrounding concrete will remain substantially intact even when the current output of the anode assembly varies with changing environmental conditions. It also implies that in more benign environments with a high resistivity, the base metal consumption will be reduced and the life of the anode assembly will be extended.

Example 4

The effectiveness of Laponite clay and a hydrated high alumina cement matrix to impede the diffusion of sulphate anions was investigated. A mixture of multipurpose finishing plaster, potassium sulphate and tap water in the proportions of 99:1:70 by weight respectively was cast in a mould measuring 200 mm by 100 mm by 50 mm to produce rigid porous gypsum. After 24 hours the gypsum was demoulded and sliced across its width using a circular saw to create two samples measuring 15 mm by 100 mm by 50 mm.

A Laponite clay (described in Example 2) was mixed with deionised water in the proportion 1 Laponite to 5 water by weight using a high shear mixer. The solution was mixed for 20 minutes and allowed to stand for a further 40 minutes before use. A 1 mm thick layer of the resulting mixture was brush applied to the 100 mm by 50 mm face of one of the gypsum samples and allowed to dry for several hours in laboratory conditions at 15 to 20° C.

High alumina cement, ordinary Portland cement and tap water in the proportions 25:25:19 by weight respectively were mixed together to produce a cement paste with a high calcium aluminate content. This paste was brush applied over the Laponite layer to give a second layer approximately 2 mm thick which was allowed to cure.

Figure 10:
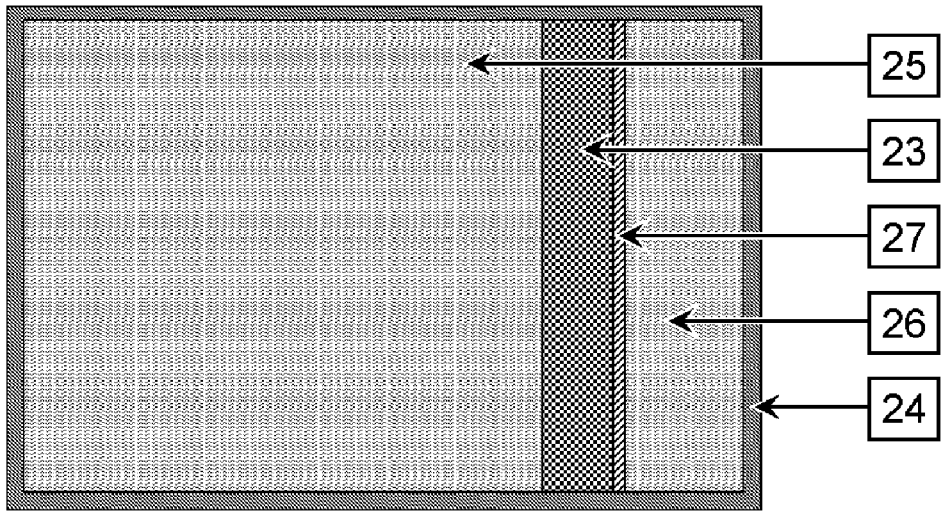
FIGS. 10(*a*) and (*b*) shows two sections through the arrangement used to test the layers in Example 4.
Figure 10:
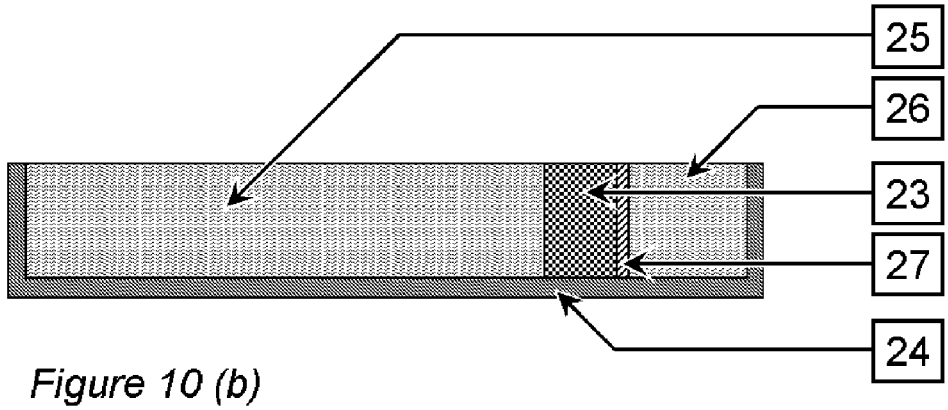

FIGS. 10(*a*) and (*b*) shows the layout that was used to test the two gypsum samples. The samples [23] were fixed into separate moulds [24] measuring 200 mm by 100 mm by 50 mm using silicone sealant to create a water tight seal. The samples split the moulds into two sections of uneven volume. The larger section [25] had a volume that was approximately 5 times the volume of the smaller section [26]. The layers [27] on the sample with layers faced the smaller section [26] of the mould in which it was sealed.

After the sealant had cured for 24 hours, the larger section of each mould was filled with a 10% solution of potassium sulphate. The smaller section was filled with tap water. A few drops of the tap water from the smaller section of each of the two test arrangements were periodically removed and put into a 4% solution of barium nitrate. A resulting white precipitate indicates the formation of barium sulphate and the presence of soluble sulphate in the tap water. No soluble sulphate was initially detected in the tap water. After 24 hours the tap water was tested again and the water in contact with the gypsum sample with no applied layers showed the presence of soluble sulphate.

After 4 days the gypsum sample with the layers still showed no soluble sulphate in the tap water. This shows that the layers impede the movement of sulphate ions away from the gypsum sample.

Example 5

The dimensional stability of gypsum was analysed. Six gypsum specimens measuring 9 mm by 20 mm by 140 mm were cut from plaster board. The longest side was then measured to 0.01 mm accuracy using a set of digital callipers. Three of the specimens were placed into an empty container representing a dry environment. The remaining three were positioned above water without touching the water in a second container representing a humid environment. Both containers were sealed and placed in an oven at 40° C. for 48 hours. The length of the specimens were measured after 24 hours and 48 hours. The average expansion expressed in microstrain (μm/m) after 24 hours and 48 hours for the dry and humid environments is given in Table 1.

TABLE 1

| Exposure Time | Dry Expansion (μm/m) | Humid Expansion (μm/m) |
|---|---|---|
| 24 hrs | 20 | 260 |
| 48 hrs | 50 | 240 |

The difference between the dry and humid environments is an equivalent percentage increase in length of approximately 0.02%. This is very small and may be easily restrained in a concrete environment.

The invention claimed is:

1. A sacrificial anode assembly to protect steel in corrosion damaged reinforced concrete construction comprising a base metal less noble than steel and a catalytic activating agent that is adapted to maintain base metal activity and that is not substantially consumed during base metal dissolution and a porous layer that substantially surrounds the base metal and the catalytic activating agent wherein the assembly is a discrete sacrificial anode assembly adapted for embedment in cavities formed in reinforced concrete and a concentration gradient in the catalytic activating agent is formed across the porous layer prior to use of the assembly and the porous layer comprises a material that is substantially inert in the presence of the catalytic activating agent in that the porous layer does not react with the catalytic activating agent to substantially remove the catalytic activating agent from the soluble phase.

2. An assembly as claimed in claim 1 wherein the porous layer that substantially surrounds the base metal and the catalytic activating agent contains no substantial quantity of catalytic activating agent in its outer surface furthest from the base metal.

3. An assembly as claimed in claim 1 that has been optimised to operate with a sustainable concentration gradient of catalytic activating agent across the substantially inert porous layer such that the concentration of activating agent at the base metal is sufficient to activate the base metal and the concentration of activating agent at the periphery of the assembly presents no risk to the surrounding concrete and steel.

4. An assembly as claimed in claim 3 wherein the resistivity and thickness of the porous layer that substantially surrounds the base metal and catalytic activating agent is adapted to support an operating voltage drop across this layer of between 30 and 240 mV.

5. An assembly as claimed in claim 1 wherein the activating agent comprises sulphate or halide ions.

6. An assembly as claimed in claim 1 that includes a plurality of layers that substantially surround the base metal.

7. An assembly as claimed in claim 6 wherein an inner layer in contact with the base metal contains the catalytic activating agent and no substantial quantity of catalytic activating agent is added to an outer layer away from the base metal.

8. An assembly as claimed in claim 7 wherein the layer in contact with the base metal substantially comprises hydrated calcium mono sulphate.

9. An assembly as claimed in claim 8 wherein the hydrated calcium mono sulphate and the base metal are substantially surrounded by a layer comprising hydrated sulphate resisting Portland cement.

10. An assembly as claimed in claim 7 wherein the outer porous layer that substantially surrounds the base metal and the inner layer containing the catalytic activating agent comprises an ion exchanger with a net negative charge on the walls of its pore system.

11. An assembly as claimed in claim 7 wherein the outer porous layer that substantially surrounds the base metal and the inner layer containing the catalytic activating agent comprises one or more of the materials in the list consisting of:

carbonated hydraulic cements, hydraulic cements with a low percentage of the reactive calcium aluminate phase such as sulphate resisting Portland cement, ceramics such as fired clays, hydraulic cements based on the ettringite binder such as sulphoaluminate cements, magnesium phosphate based cements, lime mortars, lime putties, zeolites, clays, and alumino-silicates.

12. An assembly as claimed in claim 1 wherein the porous layer that substantially surrounds the base metal and catalytic activating agent is at least as inert in the presence of the catalytic activating agent as the inertness of sulphate resisting Portland cement in the presence of sulphate ions.

13. An assembly as claimed in claim 1 wherein the porous layer that substantially surrounds the base metal and catalytic activating agent comprises one or more of the materials in the list consisting of:

carbonated hydraulic cements, hydraulic cements with a low percentage of the reactive calcium aluminate phase such as sulphate resisting Portland cement, ceramics such as fired clays, hydraulic cements based on the ettringite binder such as sulphoaluminate cements, magnesium phosphate based cements, lime mortars, and lime putties.

14. An assembly as claimed in claim 1 wherein the porous layer that substantially surrounds the base metal and catalytic activating agent comprises an ion exchanger with a net negative charge on the walls of its pore system.

15. An assembly as claimed in claim 14 wherein the ion exchanger substantially comprises one or more of the materials in the list consisting of: zeolites, clays, and alumino-silicates.

16. Production of the anode assembly claimed in claim 1 which production comprises forming a mould comprising a layer of porous inorganic solid that contains no significant quantity of catalytic activating agent in its outer surface and subsequently assembling within the mould a base metal less noble than steel and a catalytic activating agent in a porous material that connects the base metal to the mould to form a single discrete unit comprising the mould and the components assembled within the mould.

17. Production as claimed in claim 16 that includes a conductor connected to the base metal that extends out of the mould.

18. Production as claimed in claim 16 that includes sealing the opening(s) to the mould after assembling the base metal and activating agent within the mould.

19. Production as claimed in claim 16 wherein the mould is substantially inert in the presence of the catalytic activating agent in that the mould does not react with the catalytic activating agent to substantially remove the catalytic activating agent from the soluble phase.

20. Production as claimed in claim 16 wherein the mould comprises one or more of the materials in the list consisting of:

carbonated hydraulic cements, hydraulic cements with a low percentage of reactive calcium aluminate such as sulphate resisting Portland cement, ceramics such as fired clays, hydraulic cements based on the ettringite binder such as sulphoaluminate cements, magnesium phosphate based cements, lime mortar, zeolites, clays, and alumino-silicates.

21. Production as claimed in claim 16 wherein the thickness and resistivity of the porous inorganic layer that forms the mould has been optimised to operate with a sustainable concentration gradient of catalytic activating agent across it at the typical current output of the anode assembly such that the concentration of activating agent at the base metal is sufficient to activate the base metal and the concentration of activating agent at the periphery of the assembly presents no risk to the surrounding concrete and steel.

22. Production as claimed in claim 21 wherein the principal catalytic activating agent comprises negative ions with a charge number of 1 and the thickness and resistivity of the porous inorganic layer that forms the mould is adapted to support an operating voltage drop across the mould of greater than 60 mV.

23. Production as claimed in claim 21 wherein the principal catalytic activating agent comprises negative ions with a charge number of 2 and the thickness and resistivity of the porous inorganic layer that forms the mould is adapted to support an operating voltage drop across the mould of greater than 30 mV.

* * * * *